US005232113A

United States Patent [19]

Chen-Tsai et al.

[11] Patent Number: 5,232,113

[45] Date of Patent: Aug. 3, 1993

[54] VENTING RESEALABLE CONTAINER CLOSURE AND ASSOCIATED METHOD OF MANUFACTURE

[75] Inventors: Charlotte H. Chen-Tsai, Murrysville; William L. Burton, Natrona Heights; John E. Cornetta, Munhall; David S. Hills, Pittsburgh, all of Pa.

[73] Assignee: Aluminum Company of America, Pittsburgh, Pa.

[21] Appl. No.: 774,931

[22] Filed: Oct. 11, 1991

[51] Int. Cl.[5] ..... B65D 53/00

[52] U.S. Cl. ..... 220/240; 220/270; 220/209; 220/203; 220/367; 525/240

[58] Field of Search ..... 220/270, 202, 203, 209, 220/240, 306, 367, 375, 336; 215/236, 260, 270, 271, 305, 306, 307; 525/240

[56] References Cited

U.S. PATENT DOCUMENTS

| | | | |
|---|---|---|---|
| 2,238,681 | 3/1939 | Dorough . | |
| 2,434,662 | 1/1948 | Latham et al. . | |
| 2,499,756 | 3/1950 | Jacobson . | |
| 2,504,270 | 4/1950 | Maclaren . | |
| 2,577,816 | 12/1951 | Schneider et al. . | |
| 2,615,857 | 10/1952 | Clarke . | |
| 2,770,608 | 11/1956 | Barker et al. . | |
| 3,021,962 | 2/1962 | Ammondson . | |
| 3,549,038 | 12/1970 | Loher | 215/260 |
| 3,929,251 | 12/1975 | Urmston . | |
| 3,969,304 | 7/1976 | Pugh et al. . | |
| 3,977,341 | 8/1976 | Jordan et al. . | |
| 3,997,076 | 12/1976 | Jordan . | |
| 4,024,981 | 5/1977 | Brown . | |
| 4,130,618 | 12/1978 | Hill . | |
| 4,148,410 | 4/1979 | Brown . | |
| 4,580,692 | 4/1986 | La Barge . | |
| 4,632,955 | 12/1986 | Cook . | |
| 4,648,528 | 3/1987 | La Barge . | |
| 4,678,096 | 7/1987 | La Baroe et al. | 220/273 |
| 4,685,849 | 8/1987 | La Barge et al. . | |
| 4,783,985 | 12/1988 | La Barge et al. . | |
| 4,799,598 | 1/1989 | McFadyen | 215/260 |
| 4,885,352 | 12/1989 | Erickson . | |
| 4,917,258 | 4/1990 | Boyd et al. | 220/240 |
| 4,928,844 | 5/1990 | La Barge . . | |
| 4,932,555 | 6/1990 | La Barge . | |
| 4,948,665 | 8/1990 | Rosén | 220/DIG. 14 |

FOREIGN PATENT DOCUMENTS

| | | |
|---|---|---|
| 1106520 | 8/1981 | Canada . |
| 0219265 | 4/1987 | European Pat. Off. . |
| 1112025 | 5/1968 | United Kingdom . |

*Primary Examiner*—Allan N. Shoap
*Assistant Examiner*—Paul A. Schwarz
*Attorney, Agent, or Firm*—Arnold B. Silverman

[57] ABSTRACT

A cap for substantially gas-tight sealing engagement with a container wall having an opening therein circumscribed by a sealing surface has an end wall and a depending skirt with a portion for securing the cap to the container wall. The cap is preferably composed of about 94.5 to 99.89 weight percent low density polyethylene and may have a polybutylene copolymer present in an amount of about 0.01 to 5.0 weight percent. A mold release agent may be employed. A tab for manual engagement to rotate the cap between a container wall sealing surface engaging position and a storage position may be provided. The cap has a vent region provided by a weakened zone that is preferably located on or near the tab. The cap is adapted once in gas-tight sealing engagement with the sealing surface of the container wall to vent automatically in the weakened zone upon predetermined internal container pressure being attained and to subsequently reseal automatically. A container in combination with such a cap is also disclosed. A method of cap manufacture is disclosed.

24 Claims, 2 Drawing Sheets

VENTING RESEALABLE CONTAINER CLOSURE AND ASSOCIATED METHOD OF MANUFACTURE

BACKGROUND OF THE INVENTION

1. Field of the Invention

This invention relates to a resealable, easy open container wall, such as a can end and, more specifically, it relates to a unique closure composition for use in such container walls.

2. Description of the Prior Art

The prior art teaches various structures for containers such as drawn and ironed cans having end panels which have integral opening devices which are generally called "easy open ends" double seamed to the can. Examples of easy open ends of the prior art are described in U.S. Pat. Nos. 3,929,251; 3,977,341; 3,997,076; 4,024,981; and 4,148,410.

The market for containers having easy open ends may be extended, particularly, though not exclusively, with respect to containers having larger capacities. This may be accomplished through the utilization of a cap to close and reseal the spout or pouring opening defined by the easy open end prior to discharge of all of the contents. Without a resealable closure cap, the liquid contents of an open container could easily spill or otherwise be lost. Also, dissociable gases, i.e., carbonation, in the remaining liquid are readily lost from unsealed, open containers, thereby altering the character of the product.

One construction for a resealable closure cap assembly is taught in U.S. Pat. No. 4,580,692. See also U.S. Pat. Nos. 4,685,849 and 4,783,985. These patents teach constructions for such a resealable closure cap assembly in association with a selectively contoured can end to accommodate the resealable closure while retaining the advantages characteristic of the easy open end. These patents disclose a sealing cap having a seal portion, an arm for securement to the container wall by means such as a rivet and a tab for use in grasping the cap to move it from one position to another. The cap is generally circular and has the arm emerging therefrom at a position generally about 90 degrees offset from the place where the tab projects outwardly.

United States patent application Ser. No. 338,096, filed on Apr. 14, 1989, discloses venting of such a resealing cap during removal of the resealing cap from the container so as to resist undesired reverse displacement of the container wall end panel which would establish a potentially serious hazard. This application discloses the use of venting channels which are transversely located in an inwardly directed ledge of the closure. See generally U.S. Pat. No. 4,928,844.

U.S. Pat. No. 4,932,555 discloses such a system which creates zones of weakness between the cap and the rivet securing the arm connecting the cap with the rivet.

United States patent application Ser. No. 338,310, filed Apr. 14, 1989, is directed toward such a system wherein improvements are provided to the container wall spout.

United States patent application Ser. No. 338,580, filed Apr. 17, 1989, discloses a releasable fastening assembly in the form of an additional projection from the cap which is adapted to cooperate with a button-like member formed in a container wall to resist undesired rotation of the cap.

United States patent application Ser. No. 397,218, filed Aug. 23, 1989, discloses the use of a plurality of stiffening ribs in such a reclosure cap so as to provide zones of different elasticity from other zones. It also discloses the absence of such ribs in the region connecting the arm which secures the cap to the container and the remainder of the cap. It also contemplates the possible omission of ribs from the region adjacent to the arm in order to provide for venting in this region.

The disclosures of all of these United States patents and co-pending United States patent applications are expressly incorporated herein by reference.

The provision of commercially acceptable resealable easy open can end constructions for current and larger volume beverage containers requires ease of application of the resealing cap over the spout, sealed retention of remaining container contents and accommodation of inherent internal can pressure that builds after resealing the can. Also desired is a can end configuration having an easy open can end which does not require the use of lever mechanisms or the like to accomplish opening of the pouring spout. Ideally, the easy open end is easily and readily opened by a user through the mere application of digital pressure in a simple and safe manner. Such construction of a resealable easy open can end should be accomplished without diminution of the convenience and cost effective nature of the basic easy open end construction during manufacturing, filling, handling, shipping, distributing, selling and consumer usage.

Experience to date with resealable caps and can end constructions, such as those disclosed in U.S. Pat. Nos. 4,580,692 and 4,648,528, the disclosures of which are incorporated herein by reference, has indicted a need to assure proper application and retention of the resealable cap over the spout defined by the easy open end.

In United States patent application Ser. No. 601,453, filed Oct. 22, 1990, entitled "Venting Resealable Container Closure Container Combination," the disclosure of which is expressly incorporated herein by reference, a unique self-venting construction for reclosure caps for pressurized containers is disclosed. In that invention the closure is so designed that if the internal container pressure exceeds a predetermined upper limit a portion or portions of the closure will be unseated so as to vent the excess pressure and will automatically reseat itself. In order to provide optimum performance of the invention disclosed in this application it is desirable to have a closure material having a number of unique properties.

It has been known to improve the characteristics of polyethylene film by blending polyethylene with other materials to enhance certain properties. See, generally, U.S. Pat. Nos. 2,434,662 and 2,499,756.

The use of anti-blocking agents to resist undesired blocking in polyethylene films has been known. See U.S. Pat. Nos. 2,770,608, 3,021,296 and 3,969,304.

It has also been known to blend polyethylene with waxes, such as paraffin wax or microcrystalline wax. See, generally, U.S. Pat. Nos. 2,504,270, 4,130,618 and 4,632,955.

U.S Pat. No. 2,615,857 discloses a gel of polyethylene and polyisobutylene employed in potting electrical components. The preferred composition contains about 7½% polyethylene and 92% polyisobutylene.

It has been known to use polyethylene materials in packaging. U.S. Pat. No. 2,577,816 discloses a mixture of paraffin wax, polyisobutylene and polyethylene to form a strong blocking resistant, waterproof coating for paper. U.S. Pat. No. 2,238,681 discloses screw closures and crown closures having ethylene polymer cushion lining having a crystalline structure. It also teaches employing modifying agents such as paraffin wax.

U.S. Pat. No. 4,885,352 is directed toward low density polyethylene plastic extruded film of the type used in wrapping and displaying foods that are to be refrigerated. It also discloses the use of a large number of possible additives for increasing the cling properties of the polyethylene film. Among the suggested cling additives are polyisobutylene.

One of the problems with caps having self-venting capabilities employed to reclose containers of pressured liquids is the need to have a material that will withstand a variety of conditions. For example, an opened container left in the hot sun or placed horizontally must be capable of venting increased pressure while resisting undesired spillage.

In spite of the prior art disclosures, there remains a very real and substantial need for a material having the unique properties required for a reclosure for container walls having a weakened zone which is adapted to fracture and create an opening which will be reclosed by cap of this invention.

SUMMARY OF THE INVENTION

The present invention has met the above-described need by providing a cap having properties uniquely designed for effective performance as a reclosure on easy open end type container walls. This is particularly so with respect to self-venting reclosures used in such an environment where the container contents are under pressure.

The cap has a top wall and a depending skirt which cooperate to define a sealing portion that is sealingly engageable in gas-tight relationship with the container sealing surface. The cap may be provided as a separate item or may be secured to the container wall as by means that will permit the cap to pivot with respect to the container wall. The cap has vent means provided by at least one weakened zone formed in the cap. Internal container pressure of a container having a pressurized liquid therein such as a carbonated soda or beer will cause venting action to occur when a predetermined pressure level has been reached with the closure subsequently resuming its sealed relationship after sufficient venting has occurred to reduce the internal container pressure to the desired level.

In a preferred embodiment of the invention the composition of the material has about 94.5 to 99.89 weight percent low density polyethylene (which may be a blend of low density polyethylenes) and about 0.01 to 5 weight percent of a polybutylene copolymer. It is also preferred to employ a mold release agent in the amount of 0.01 to 0.5 weight percent. In general, the higher the polyethylene amount the lower the pressure at which the cap will vent.

It is an object of the present invention to provide such a reclosure which will have a long shelf life and a method of manufacturing the same.

It is another object of the invention to provide such a closure which has the desired strength, flexibility and lubricity for use as an easy open end self-venting reclosure.

It is a further object of the present invention to provide such a cap composition that cures quickly and has the flexibility required for use in a self venting container environment.

It is a further object of the present invention to provide such a composition that can be converted into caps quickly and economically by conventional injection or compression molding techniques.

It is a further object of the present invention to provide a composition which may rapidly be advanced to the degree of crystallinity desired through curing.

It is an object of the present invention to provide a reclosure for easy open end container wall which may be made rapidly, has the desired properties and is economical to use.

These and other objects of the invention will be fully understood from the following description of the invention with reference to the drawings appended hereto.

DESCRIPTION OF THE PREFERRED EMBODIMENTS

The present invention is described in association with a resealable easy open end construction of the type generally disclosed in U.S. Pat. Nos. 4,580,692 and 4,648,528. However, it should be understood that the present invention is not limited to that construction and may be used in other easy open can end constructions.

Where the words "upwardly," "downwardly," "inwardly," "outwardly," and like words of orientation are used herein, unless specifically indicated to the contrary, they are to be applied with reference to a can or other container standing on its base in an upright position having a can end attached to the top end thereof.

All percentages referred to herein are weight percent.

Figure 1:
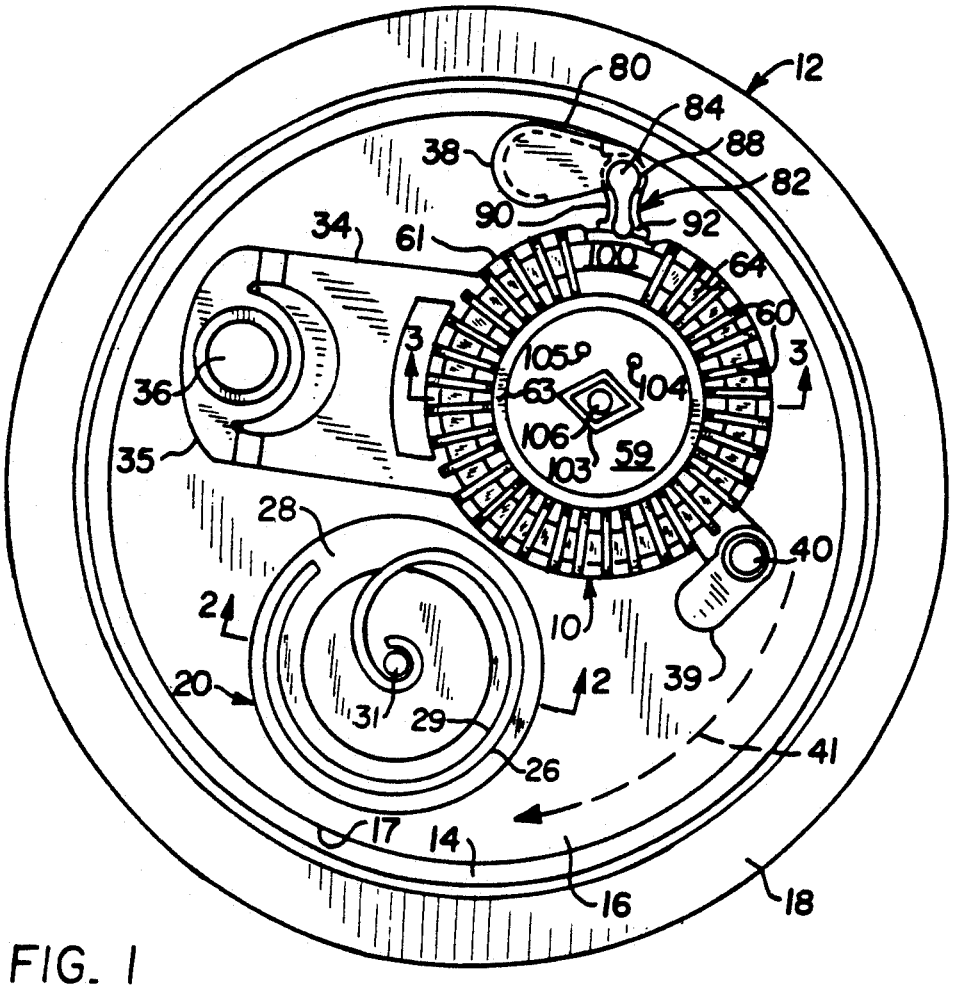
FIG. 1 is a top plan view of an easy open can end construction of a cap and container wall combination of this invention.

Referring more particularly to the drawings, FIG. 1 illustrates a top plan view of an easy open can end construction. FIG. 1 shows a cap 10 secured to a can end closure 12 prior to securement to the top end of a generally cylindrical can body, such as by conventional double seaming, for example. Such can end closure 12 is generally made of sheet metal, such as aluminum, steel or tinplate, but may be made of nonmetallic or laminated materials. The closure 12 includes a generally flat or planar end wall 16, a countersink defining an inner panel wall 17, and an outer chuckwall 14 terminating in an upwardly and outwardly projecting annular flange 18 forming a chime for conventional attachment of the sheet metal can end 12 to a can body by double seaming.

Figure 2:
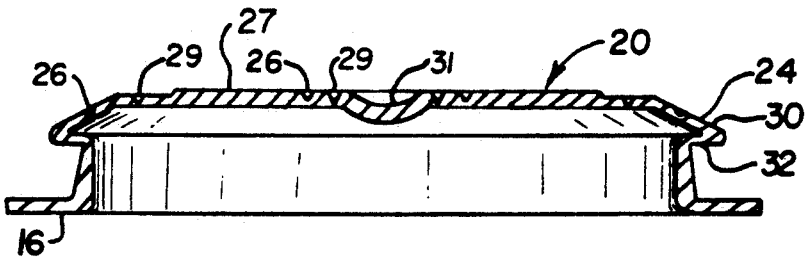
FIG. 2 is a cross-sectional illustration taken through 2—2 of FIG. 1 of the portion of the container wall adapted to be opened for dispensing the container contents.

As best shown in FIGS. 1 and 2, the can end closure 12 further includes an upwardly projecting dispensing spout 20 or pouring opening. The spout 20 is typically of circular configuration and is formed as an integral portion of the can end closure 12. Although the preferred spout 20 is circular, it should be understood that alternate configurations, including oval, teardrop and ellipsoidal shapes, or other desired shapes may be employed with the present invention. The spout 20 may include a removable or partially removable panel 27 defined by a pair of spiral score lines 26, 29 or any other desired score line pattern. The central portion 31 of panel 27 has a depressed section adjacent to score lines 26, 29. The score lines 26, 29 are interrupted by a hinge 28, but otherwise the score lines 26, 29 circumscribe and define an opening panel 27 which is depressible inwardly into the can upon progressive fracture of the score lines 26, 29. The opening panel 27 and the score lines 26, 29 are surrounded by a continuous lip 24 having substantially smooth sealing surfaces 30 and 32 to which the resealing cap 10 will be secured. In the preferred embodiment, the lip 24 is circular in plan.

Figure 3:
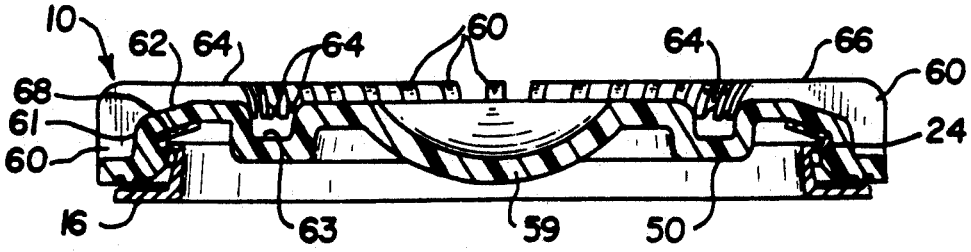
FIG. 3 is a cross-sectional illustration taken through 3—3 of FIG. 1 showing the cap in overlying relationship with respect to the portion of the container wall which has been opened to create a pour spout.

As shown in FIGS. 1 through 3, the present invention has a resealing cap 10 which is adapted to be positioned over the lip 24 to seal the spout 20 after opening. The cap 10 is preferably molded in one piece of a resinous material having a relatively low modulus of elasticity. In addition to a low modulus of elasticity, suitable cap materials typically exhibit thermal and dimensional stability, chemical resistance, strength and durability.

As shown in FIGS. 3–6, the resealing cap 10 includes a top panel 59 and a depending skirt 61 which has a sealing portion defining an inwardly open annular locking recess 68, adapted to be placed in sealing overlying relationship over the opening in spout 20 and in sealed engagement with sealing surfaces 30, 32. The cap 10 also includes an integral tab 38 (FIG. 4) projecting generally radially outwardly from the cap skirt 61. The tab 38 has a generally circumferentially oriented gripping portion to facilitate digitally manipulating the cap 10. In a preferred embodiment an integrally formed, generally radially extending arm 34 extends generally radially from the cap skirt 61 at a position generally 90 degrees offset from tab 38 in the form shown and terminates in a boss 35. The boss 35 has an opening 37 therethrough to accommodate a rivet 36 (FIG. 1) for pivotally securing the cap assembly 10 to the can end wall 12. An example of another construction to which the cap assembly of this invention may be applied, such as by an integral rivet, is described in U.S. Pat. No. 4,890,759.

As shown in FIGS. 3 through 6, the cap 10 preferably has a plurality of alternating radial sections having relatively reduced thickness with respect to adjacent radial sections. These relative thicknesses may be achieved by providing radial zones of lesser thickness than the remaining alternating zones. For convenience of reference herein, this construction will be considered as having a plurality of outwardly projecting ribs 60 extending from the top panel 59 into skirt 61 and are relatively spaced by unribbed thinner portions 64. An upwardly open annular channel 63 (FIG. 6) separates the inner portion of top panel 59 from the radially outer rib containing portion thereof.

The outer portion of a flange of the rivet 36 (FIG. 1) is formed downwardly a controlled amount when the rivet 36 is staked to securely attach the cap 10 to the can end closure 12. The rivet 36 also permits the cap 10 to be rotated by hand about the rivet 36 with relative ease as indicated by dotted line 41 in FIG. 1. Preferably the rivet is an integrally formed portion of a sheet metal end wall 16 created in a manner well known to those skilled in the art.

Tab 39 (FIGS. 1 and 4) is integrally formed with the cap 10. It projects generally radially outwardly from cap skirt 61, and has a generally circumferential gripping tab extension, has a portion which is frictionally engaged with bubble 40 which is formed within and projecting out of the container end wall 12, and serves to resist undesired rotation of the cap about rivet 36. Details of such construction, which form no part of the present invention, are illustrated in co-pending U.S. patent application Ser. No. 338,580.

Figure 4:
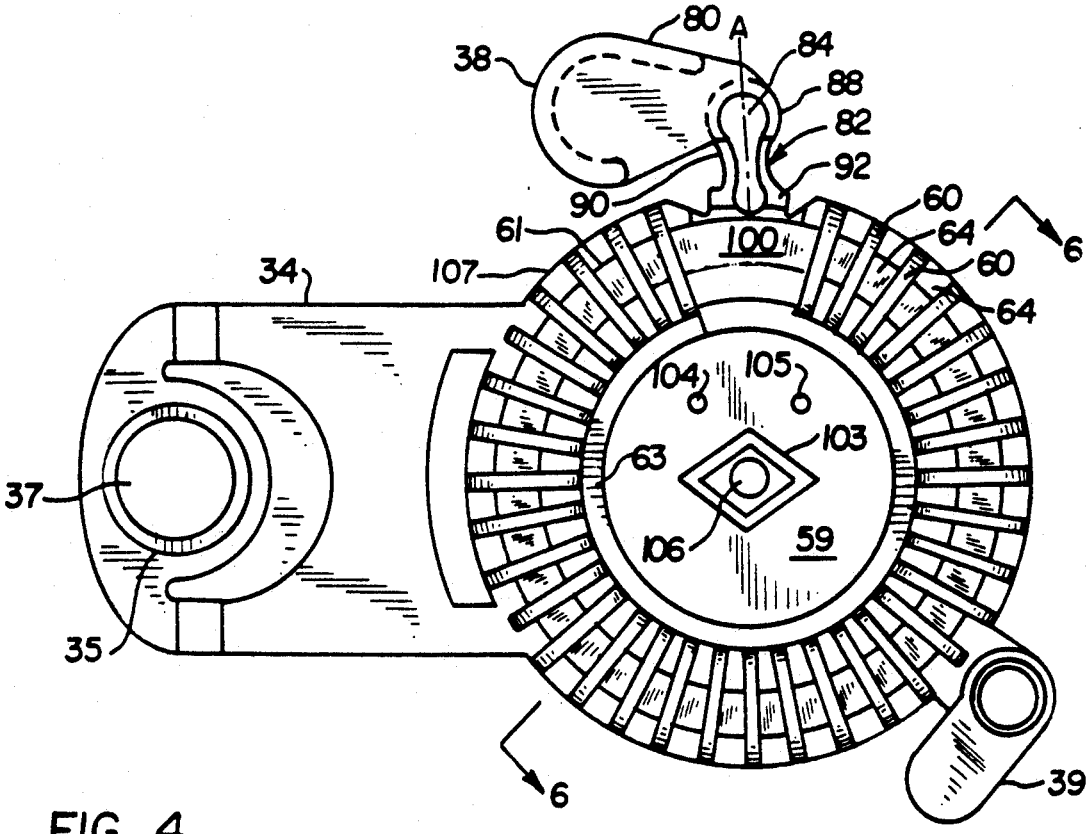
FIG. 4 is a top plan view of one form of the cap of the present invention.
Figure 5:
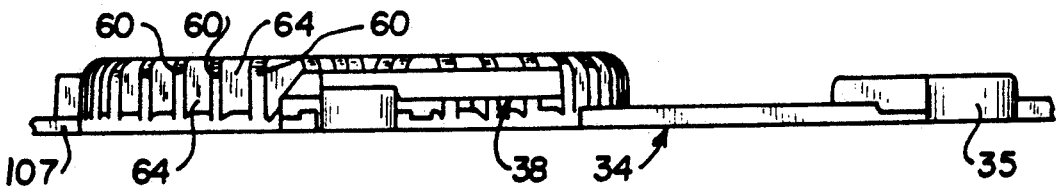
FIG. 5 is an elevational view of a form of the cap of the present invention.

As shown in FIGS. 1 and 4, the tab means 38 which are adapted to be manually engaged in lifting the cap so as to rotate the same between a container sealing position (FIG. 3) and a storage position (FIG. 1) is preferably integrally formed with cap. The tab means 38 projects generally radially from the cap skirt 61 and consists of a gripping portion 80 and a connecting portion 82 which is connected to cap skirt 61. In the form illustrated, the connecting portion 82 has a generally hourglass shape which surrounds a central opening 84. The portion which is connected to the gripping portion 80 is enlarged with respect to intermediate portion 90 and is of lesser transverse extent than the portion 92 which is connected to the main body of the cap. This hourglass configuration of the connecting portion 82 and opening 84 provides a very flexible construction so as to facilitate flexing thereof and localized deformation which creates a venting action in this region of the closure cap.

The closure cap will automatically vent in a weakened region at a predetermined pressure. After venting, the closure cap will automatically reseat itself in sealed position. This is accomplished by creating a zone of weakness in the closure cap, preferable in the general region where tab means 38 connects to cap skirt 61. This zone of weakness facilitates local venting when the predetermined pressure is reached. Numerous means for providing such zone of weakness may be employed alone or in various combinations. The cap composition of the present invention facilitates effective venting and automatic resealing.

Shown in FIG. 4 is a region 100 of the top panel 59 and depending skirt 61 of the cap. This region 100 is preferably devoid of ribs. This results in region 100 being more flexible than other comparably sized zones of the cap and will serve in a manner described hereinafter to facilitate circumferential expansion of the closure skirt during venting. The hourglass shape of the tab connecting means 88 similarly serves to facilitate this.

Figure 6:
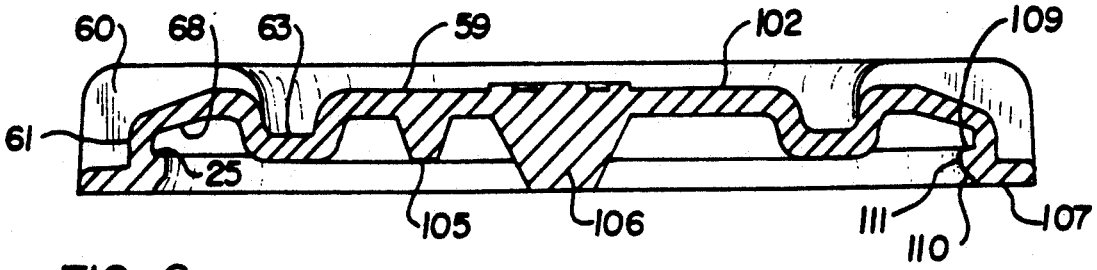
FIG. 6 is a cross-sectional illustration of the cap of the invention taken through 6—6 of FIG. 4.

As shown in FIGS. 4 and 6, the top wall 59 has a central region which is essentially devoid of ribs 60 and has a diamond shaped portion 103 underlying which is a downwardly projecting boss 106 which in a manner taught by the prior art serves to facilitate fracture of container wall score line 26 by positioning the cap in overlying relationship with respect to opening panel 27 and manually pressing downwardly in the region of the diamond 104. In a preferred form, additional downwardly projecting bosses 104, 105 serve to enhance this opening action.

In a preferred embodiment, the region 100 will be symmetrical about or centered on the centerline A (FIG. 4) of tab connecting means 82 and will cover an arc of about 30 to 70 degrees of the cap with about 40° F. degrees being preferred.

It will be appreciated that while it is preferred to use a single venting zone 100 which is positioned adjacent to tab means 38, if desired, one or more additional such zones could be provided or a single zone disposed in another location could be employed.

A reason for preferring to have the zone of weakness disposed adjacent to where the tab means 38 and connection portion 82 meet the cap skirt 61, is that lifting the tab means 38 facilitates immediate venting. This reduces the likelihood of undesired, uncontrolled acceleration of cap removal due to rapid pressure release.

It will be appreciated that the weakened venting zone also facilitates automatic venting and reseating of the cap during container storage after opening and restorage.

The preferred composition of the cap of the present invention comprises a low density polyethylene present in the weight percent based on total composition of about 94.5% to 99.89 weight percent and a copolymer of polybutylene in the amount of about 0.01 to 5 percent and preferably about 0.5 to 1.5 weight percent. It is also preferred to employ a mold release agent in the amount of about 0.01 to 0.5 percent. The low density polyethylene may be a blend of different low density polyethylenes rather than using just a single low density polyethylene. Linear low density polyethylene may be employed. The reference herein to "low density polyethylene" shall refer to such blends as well as a single low density polyethylene.

The low density polyethylene preferably has a density of about 0.917 to 0.925 gm/cm$^3$, a melt index of about 10 to 30 grams per ten minutes at 180° C. in accordance with ASTM Standard D-1238 and a modulus of about 25,000 psi to 75,000 psi and preferably about 14,000 to 36,000 psi. A suitable low density polyethylene is that marketed by Chevron under the trade designation 1008.5 or Dow Chemical under the trade designation 993. Other suitable materials for the low density polyethylene are Chevron KN230B with antiblock, and Chevron KN230.

A suitable copolymer of polybutylene may contain about 0.01 to 5 weight percent of ethylene.

The copolymer of polybutylene reduces the cycle time needed to get the material out of a mold so that the material remains flexible in a process where one side is warm while the opposite side is cool. It further reduces the curing time in the mold. For example, the total melt cycle time for the composition of the present invention may be less than about 4 seconds. Further, the copolymer of polybutylene serves to interfere with or inhibit crystallization. The increases in crystallinity equates with a higher modulus. In preferred practice of the invention, the cap has been cooled after molding and then heat-treated after forming so as to enhance shelf-life of the material by restraining crystallinity. While the post-treatment may be preferred in an aging process at room temperature, it is preferred to cure the cap at about 100° F. to 120° F. for at least about 8 to 16 hours. This post-treatment serves to establish the desired low modulus by accelerating crystallization to its asymptote and thereby stabilize this property at the desired level. This causes the cap to resist undesired changes in properties during storage.

The shelf-life of the cap material has been found to be on the order of about 6 to 12 months without undesired change in properties due to undesired crystallization.

The mold releasing agent or blooming agent serves to aid in molding the cap. It provides an internal and external lubricant to allow the cap after molding to be readily removable from the forming mold.

A suitable copolymer of polybutylene is that sold by Shell Oil under the trade designation 8640. A suitable mold release agent is that sold under the trade designation Kemamide-U by Hunke Chemical Corporation.

The preferred cured material of the present invention has been found to be flexible in terms of tensile modulus which was on the order of about 14,000 psi to 36,000 psi in the sheet form having a thickness of about 60 to 125 mil prior to molding and most preferably about 8,000 to 18,000 psi. Flexibility is important as it facilitates sealed application of the reclosure to the opening in the container and the ability to flex in response to internal can pressure so as to vent automatically. Finally, it facilitates ease of removal.

The preferred low density polyethylene of the present invention will have a shear viscosity range from about $10^6$ poise at a shear rate of about $10^{-2}$/sec to about poise at a shear rate of about $10^4$/sec within the processing temperature range of about 180° C. to 260° C. The shear viscosity for a given shear rate is reduced with increasing temperature.

It will be appreciated therefore, that the composition of the present invention is uniquely suited to manufacture of a cap for use as a reclosure on easy open end containers. The material is moldable, cures quickly, is strong and yet flexible. It may be molded by conventional injection molding or compression molding techniques. The material uniquely suited for use in connection with reclosure of containers having pressurized contents.

In the manufacture of the cap of the present invention, the component materials may be mixed in a manner well known to those skilled in the art, melted at a temperature of about 260° F. to 400° F. and then molded in a conventional manner as by injection molding techniques. It may be advantageous to design the cap mold so as to mold a plurality of caps connected to each other such as about 4 to 12, for example, to facilitate ease of handling of multiple units. The individual caps may be separated easily at the desired time.

It is desired that the annealed product have a density in grams per cubic centimeter of about 0.912 to 0.935 gm/cm$^3$. The cap should preferably have elastic elongation in the range of about 5 to 10 percent.

As will be appreciated by those skilled in the art, variations in the properties of the cap may be effected within the parameters of the compositions preferred hereunder in relationship to the specific structural design of the closure cap. Such variations may be made readily by those skilled in the art on the basis of the information disclosed herein. Also, if desired, additives well known to those skilled in the art may be added.

An example of a suitable polybutylene copolymer is one which which has a melt index of 1.0 grams per 10 minutes, a density of 0.908 grams per cubic centimeter, a tensile strength at yield of 1700 psi and at fracture of 4500 psi with a percentage of elongation of 1000 percent. It may have a modulus of elasticity of $2.8 \times 10^4$, a brittleness of −4° F.

EXAMPLES

In order to provide additional guidance as to the preferred practice of the invention several examples will be provided.

A cap of the type disclosed herein was made employing 98.975 weight percent low density polyethylene, 1 weight percent copolymer of polybutylene and 0.025 weight percent mold release agent. The cap was allowed to cool to room temperature after molding and was then cured at about 120° F. for about 12 hours. Both dynamic and static pressure testing of the cap applied to container of a carbonated beverage confirmed that the cap vented and unseated at the desired pressure range and resealed. The venting occurred at 50–60 psi in the dynamic vent pressure test. The cap static test maintained a sealed condition at an internal pressure of about 35–45 psi for over the desired 5 day test period and maintained a sealed condition at pressures of about 55–60 psi for over the desired 28 hours.

A similar test employing a blend of linear low density polyethylene (LLDPE) and another low density polyethylene (LDPE) in the ratio of about 2 parts LLDPE to LDPE with similar successful results.

The cap of the present invention, therefore, accomplishes the desired objectives.

It will be appreciated, therefore, that the present invention has provided a cap for reclosing an easy open end container wall and particularly one suited to use in a self-venting closure employed on containers having pressurized liquid therein. The cap has the desired blend of flexibility and strength to permit it to withstand the forces required to avoid leakage of the contents while facilitating closure, reclosure and self-venting in the desired manner. The cap also has prolonged shelf-life, is readily moldable, and is economically practical. Post thermal treatment accelerates crystallization to reach the maximum level and thus stabilize the cap and resist subsequent undesired changes.

Whereas particular embodiments of the invention have been described for purposes of illustration, it will be evident to those skilled in the art that numerous variations of the details may be made without departing from the invention as defined in the appended claims.

We claim:

1. A cap for substantially gas-tight sealing engagement with a container wall having an opening therein circumscribed by a sealing surface, said cap comprising, a top wall and a depending skirt cooperating therewith to define a sealing portion which is sealingly engageable in gas-tight relationship with said sealing surface, means for securing said cap to said container wall, said cap having vent means provided by at least one weakened zone, whereby said vent means will, when container pressure exceeds a predetermined level, move a portion of said cap away from said sealing surface to vent said container and subsequently automatically reestablish sealed contact with said sealed container, and said cap being composed from a material comprising about 94.5 to 99.89 percent low density polyethylene and about 0.01 to 5 percent polybutylene copolymer.

2. The cap of claim 1 wherein said low density polyethylene has a density of about 0.917–0.925 gm/cm$^3$.

3. The cap of claim 2 wherein said cap comprises about 98.6 to 98.9 percent low density polyethylene and about 0.01 to 5 percent of a polybutylene copolymer.

4. The cap of claim 2 wherein said polybutylene copolymer is present in an amount of about 0.5 to 1.5 percent.

5. The cap of claim 4 wherein said cap has a mold release agent present in the amount of about 0.01 to 0.5 percent.

6. The cap of claim 4 wherein said cap has about 98.6 to 98.9 percent low density polyethylene.

7. The cap of claim 6 wherein said cap has manually engageable tab means for facilitating movement of said cap between a sealed position and an unsealed position.

8. The cap of claim 6 wherein said low density polyethylene has a melt index of about 10 to 30 grams per 10 minutes.

9. The cap of claim 8 wherein said low density polyethylene material has a tensile modulus measured in sheet form of about 8,000 to 18,000 psi.

10. The cap of claim 9 wherein said cap is characterized by having been annealed after molding to stabilize its physical properties.

11. The cap of claim 9 wherein said container wall is metal and said cap is an injection molded cap.

12. The cap of claim 9, wherein said low density polyethylene has a shear viscosity that ranges from about $10^6$ poise at a shear rate of about $10^{-2}$/sec to $10^2$ poise at a shear rate of about $10^4$/sec within the temperature range of about 180° C. to 260° C.

13. A container-cap assembly comprising a container end wall having a score line defined removable panel, removal of which establishes a pour opening, said container end wall having an upwardly projecting continuous sealing surface surrounding said pour opening, a resealing cap rotatably secured to said container end wall and adapted to assume a first position in overlying gas-tight sealing relationship with respect to said container sealing portion, said cap having a top wall and a depending skirt which cooperates therewith to define a sealing portion which is sealingly engageable in gas-tight relationship with said sealing surface, said cap having means for securing said cap to said container and wall, said cap having manually engageable tab means for facilitating movement of said cap between a sealed position and an unsealed position, vent means defined in said cap by at least one weekend zone, and said cap being composed of a material comprising of about 94.5 to 99.89 percent low density polyethylene and about 0.01 to 5 percent polybutylene copolymer.

14. The container-cap assembly of claim 13 wherein said low density polyethylene has a density of about 0.917 to 0.925 gm/cm$^3$.

15. The container-cap assembly of claim 14 wherein said cap is composed of about 98.6 to 98.9 percent low density polyethylene and about 0.01 to 5.0 percent of a polybutylene copolymer.

16. The container-cap assembly of claim 14 wherein said composition of polybutylene copolymer is present in the amount of about 0.5 to 1.5 percent.

17. The container-cap assembly of claim 16 wherein said cap has a mold release agent present in the amount of about 0.01 to 0.5 percent.

18. The container-cap assembly of claim 17 wherein said cap has manually engageable tab means for facilitating movement of said cap between a sealed position and an unsealed position.

19. The container-cap assembly of claim 13 including said low density polyethylene has a shear viscosity that ranges from about $10^6$ poise at a shear rate of about $10^{-2}$/sec to $10^2$ poise at a shear rate of about $10^4$/sec within the temperature range of about 180° C. to 260° C.

20. The container-cap assembly of claim 17 wherein said low density polyethylene has a melt index of about 10 to 30 grams per 10 minutes.

21. The container-cap assembly of claim 17 wherein said low density polyethylene material has a tensile modulus measured in sheet form of about 8,000 to 18,000.

22. The container-cap assembly of claim 21 including said container wall being made of metal and said cap is injection molded.

23. The container-cap assembly of claim 13 wherein said weakened zone is disposed on said tab means.

24. The container-cap assembly of claim 13 wherein said weakened zone is disposed adjacent to said tab means.

* * * * *